US009147939B2

(12) United States Patent
Kaneda et al.

(10) Patent No.: US 9,147,939 B2
(45) Date of Patent: Sep. 29, 2015

(54) BROADSIDE ANTENNA SYSTEMS

(71) Applicant: Alcatel-Lucent USA Inc., Murray Hill, NJ (US)

(72) Inventors: Noriaki Kaneda, Westfield, NJ (US); Shahriar Shahramian, Chatham, NJ (US); Yves Baeyens, Stirling, NJ (US); Young-Kai Chen, Berkeley Heights, NJ (US)

(73) Assignee: Alcatel Lucent, Boulogne-Billancourt (FR)

( * ) Notice: Subject to any disclaimer, the term of this patent is extended or adjusted under 35 U.S.C. 154(b) by 252 days.

(21) Appl. No.: 13/853,600

(22) Filed: Mar. 29, 2013

(65) Prior Publication Data

US 2014/0292604 A1 Oct. 2, 2014

(51) Int. Cl.

| | |
|---|---|
| ***H01Q 19/30*** | (2006.01) |
| ***H01Q 21/08*** | (2006.01) |
| ***H01Q 9/16*** | (2006.01) |
| ***H01Q 13/00*** | (2006.01) |
| ***H01Q 9/04*** | (2006.01) |
| ***H01Q 9/06*** | (2006.01) |
| ***H01Q 9/28*** | (2006.01) |

(52) U.S. Cl.

CPC ..... *H01Q 9/16* (2013.01); *H01Q 9/0407* (2013.01); *H01Q 9/065* (2013.01); *H01Q 9/285* (2013.01); *H01Q 13/00* (2013.01); *H01Q 19/30* (2013.01); *H01Q 21/08* (2013.01)

(58) Field of Classification Search

CPC ..... H01Q 19/30

See application file for complete search history.

(56) References Cited

U.S. PATENT DOCUMENTS

| | | | | |
|---|---|---|---|---|
| 6,198,437 | B1 | 3/2001 | Watson et al. | |
| 8,022,887 | B1 * | 9/2011 | Zarnaghi | 343/846 |
| 2005/0026655 | A1 * | 2/2005 | Giaimo et al. | 455/557 |
| 2006/0071858 | A1 | 4/2006 | Suh | |
| 2007/0195004 | A1 | 8/2007 | Rebeiz et al. | |
| 2008/0272976 | A1 | 11/2008 | Kitamori et al. | |
| 2009/0046019 | A1 * | 2/2009 | Sato | 343/702 |
| 2011/0241960 | A1 * | 10/2011 | Lu et al. | 343/833 |

FOREIGN PATENT DOCUMENTS

| | | | |
|---|---|---|---|
| EP | 0957537 | A2 | 11/1999 |
| EP | 1684382 | A1 | 7/2006 |
| EP | 2120288 | A1 | 11/2009 |
| JP | S 60-214605 | A | 10/1985 |

OTHER PUBLICATIONS

Kaneda, N. et al., "A Broad-Band Planar Quasi-Yagi Antenna," IEEE Transactions on Antennas and Propagation, vol. 50, No. 8, pp. 1158-1160, Aug. 2002.

Pozar, D., "Analysis of an Infinite Phased Array of Aperture Coupled Microstrip Patches," IEEE Transactions on Antennas and Propogation, vol. 37, No. 4, pp. 418-425, Apr. 1989.

(Continued)

*Primary Examiner* — Robert Karacsony

(74) *Attorney, Agent, or Firm* — Harness, Dickey & Pierce, P.L.C.

(57) ABSTRACT

At least one example embodiment discloses an antenna system. The antenna system includes a single printed circuit board (PCB) substrate and an antenna integrated with the single PCB substrate, the antenna being a broadside low-profile microstrip antenna.

6 Claims, 9 Drawing Sheets

(56) References Cited

OTHER PUBLICATIONS

Shahramian, S. et al., "A 70-100GHz Direction-Conversion Transmitter and Receiver Phased Array Chipset Demonstrating 10Gb/s Wireless Transmission," May 2013.

International Search Report and Written Opinion dated Nov. 11, 2014.

Deal, R. e al., "A New Quasi-Yagi Antenna for Planar Active Antenna Arrays," IEEE Transactions on Microwave Theory and Techniques, vol. 48, No. 6, Jun. 1, 2000.

International Search Report dated Aug. 1, 2014.

* cited by examiner

BROADSIDE ANTENNA SYSTEMS

BACKGROUND

The use of high-performance SiGe BiCMOS and nano-scale CMOS technologies in millimeter wave applications has been explored. Some Si-based receivers and transmitters operate up to D-band and in high integration density enabled fully integrated multi-channel arrays. Most of these arrays target either radar and imaging or short-distance data-links at 60 GHz. The antennas for those applications are desired to be low profile, broadside directive, broadband, having low mutual coupling and low cost.

One type of wideband antenna is an aperture coupled patch antenna as described in *Analysis of an Infinite Phased Array of Aperture Coupled Microstrip Patches*, IEEE Trans. AP, Vol. 37, No. 4, April 1989, Pozar et al. The patch antenna includes a radiating patch printed on a top substrate and a microstrip feed line printed on a bottom substrate. A small aperture in a ground plane couples the radiating patch to the microstrip. This type of antenna, however, has electromagnetic coupling between the feedlines to the radiative elements and tends to have stronger mutual coupling between neighboring elements.

SUMMARY

Example embodiments disclose broadside antenna systems.

Conventional antenna arrays operating in a W-band (70-100 GHz) or other millimeter-wave (above 30 GHz) frequency utilize a conventional microwave substrate such as quartz or multiple substrates. By contrast, at least some example embodiments disclose antenna arrays operating in a W-band (70-100 GHz) or other millimeter-wave (above 30 GHz) that include a single printed circuit board (PCB) substrate. The usage of a single PCB substrate enables integration of antennas into a control circuit and simplifies the fabrication of the array and the antenna systems including Silicon devices and surface mount components.

At least one example embodiment discloses a broadside antenna system including a single printed circuit board (PCB) substrate and an antenna integrated with the single PCB substrate, the antenna being a broadside low-profile microstrip antenna.

In an example embodiment, the single PCB substrate includes a truncated microstrip ground plane at a first side of the single PCB substrate and another ground plane at a second side of the single PCB substrate, the first and second ends being opposite sides of the single PCB substrate.

In an example embodiment, the antenna is a dipole antenna including a dipole driver element.

In an example embodiment, the antenna is configured to operate in a band of millimeter-wave.

In an example embodiment, the antenna is configured to operate in a band of 70-100 GHz.

In an example embodiment, the single PCB substrate includes a reflector at a third side of the single PCB substrate.

In an example embodiment, the reflector is a quarter-wave reflector and a conductor ground plane.

In an example embodiment, the antenna system includes ground vias extending from the dipole reflector to a top of the single PCB substrate.

In an example embodiment, the ground vias extend through the another ground plane.

In an example embodiment, the truncated microstrip ground plane is a quarter wave reflector.

In an example embodiment, the antenna includes a broadband coplanar stripline (CPS) to a microstrip balun, the CPS configured to receive a signal.

In an example embodiment, the antenna is configured to achieve broadband input impedance matching of a 20 GHz input return loss higher than 10 dB for a millimeter-wave operating band due to an optimization of multiple resonances in the system.

In an example embodiment, the antenna achieves mutual coupling between elements of the antenna system below −15 dB over a millimeter-wave operating band.

In an example embodiment, the antenna includes a director element above the dipole driver element, the director element and dipole element cooperatively configured to generate broadside Yagi radiation.

In an example embodiment, the antenna is configured to operate in a band of millimeter-wave.

In an example embodiment, the antenna is configured to operate in a band of 70-100 GHz.

In an example embodiment, the antenna is configured to generate broadside radiation in a same plane as an integrated output/input of the antenna system.

At least one example embodiment discloses a broadside antenna system including a single printed circuit board (PCB) substrate and an antenna integrated with the single PCB substrate, the antenna being a broadside low-profile coplanar waveguide (CPW) antenna.

BRIEF DESCRIPTION OF THE DRAWINGS

Example embodiments will be more clearly understood from the following detailed description taken in conjunction with the accompanying drawings. FIGS. 1-4 represent non-limiting, example embodiments as described herein.

FIG. 1 illustrates an antenna system according to an example embodiment;

FIG. 4 illustrates a substrate according to an example embodiment; and

DETAILED DESCRIPTION

Figure 1:
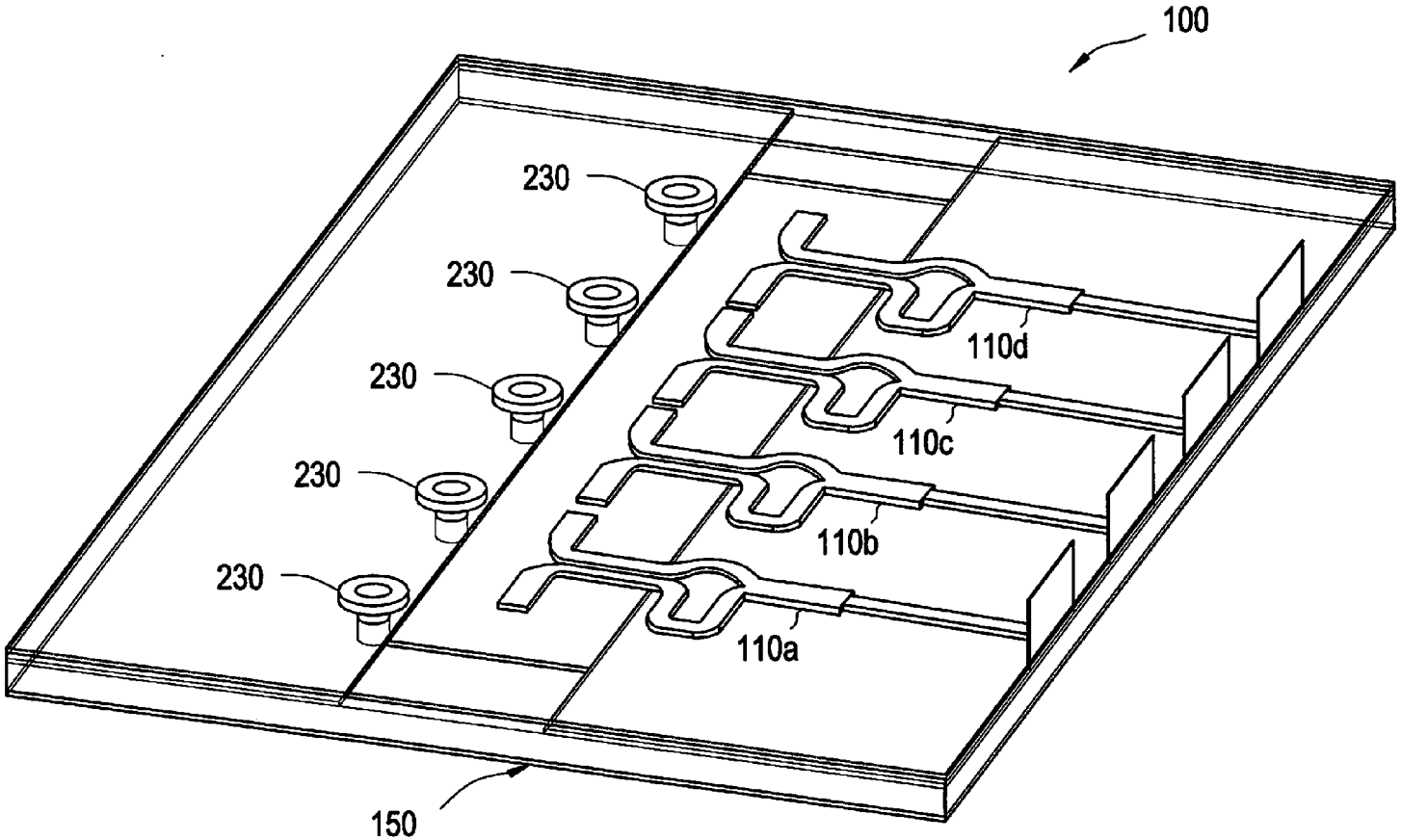

Various example embodiments will now be described more fully with reference to the accompanying drawings in which some example embodiments are illustrated.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the claims. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

FIG. 1 illustrates an antenna system according to an example embodiment. As shown, the antenna system includes an antenna array 100 having a plurality of broadside antennas 110*a*-110*d* integrated in a single printed circuit board (PCB) substrate 150. In FIG. 1, the antennas 110*a*-110*d* are broadside dipole antennas configured to operate in a high frequency. The antennas 110*a*-110*d* are configured to generate broadside radiation in a same plane as an integrated output/input of the antenna system. However, it is understood that various other types of antennas may be used such as patch antenna and various Yagi antennas.

The substrate 150 is a high-speed substrate which is a substrate with a low dielectric loss tangent at a high frequency.

The broadside antennas 110*a*-110*d* are integrated with the substrate 150 in a single fabrication process. The inventors have discovered that using a high-speed PCB substrate for broadside antenna array fabrication further advances the knowledge and techniques of millimeter-wave antenna integration. Such a PCB fabrication process enables the integration of broadside antennas into a control circuit and achieves simplification of overall module fabrication.

A single fabrication is a substrate made by standard PCB process, i.e., layer by layer dielectric substrate and copper clad substrate lamination process. Such a process provides a matched thermal expansion coefficient and established low-cost fabrication process as opposed to a hybrid fabrication where multiple substrates are bonded together often manually thus with increased cost and the thermal expansions between materials may be unmatched. The antenna which consists of metal patterns in different layers and dielectric substrates that support the metal patterns is fabricated in this process.

Since the antennas 110*a*-110*d* are fabricated using a standard PCB process, the antennas 110*a*-110*d* are easily integrated with other circuits of a transmitter and/or receiver. These circuits include DC power supplies which are fabricated on the substrate, surface mount components, thermal vias and pedestals for silicon ASICs such as described in Shahramian, et al., *A* 70-100 *GHz Direct-Conversion Transmitter and Receiver Phased Array Chipset Demonstrating* 10 *Gb/s Wireless Transmission*, the entire contents of which are hereby incorporated by reference.

The substrate 150 typically has a low permittivity of below 4, as opposed to a high permittivity material such as Duroid or Silicon.

For example, the substrate 150 may be a Megtron 6 (Panasonic), liquid crystal polymer (LCP) or made of other materials suitable for high frequency operation. Using a Megtron 6, the antenna is fabricated in Megtron as opposed to some other substrates which are separate from the rest of the board level control and power supply circuits.

In example embodiments, high frequency refers to a frequency where a wavelength has approximately a same or smaller dimension than the substrate thickness of the antenna. In an example embodiment, high frequency may refer to a bandwidth between 70-100 GHz.

Figure 2A:
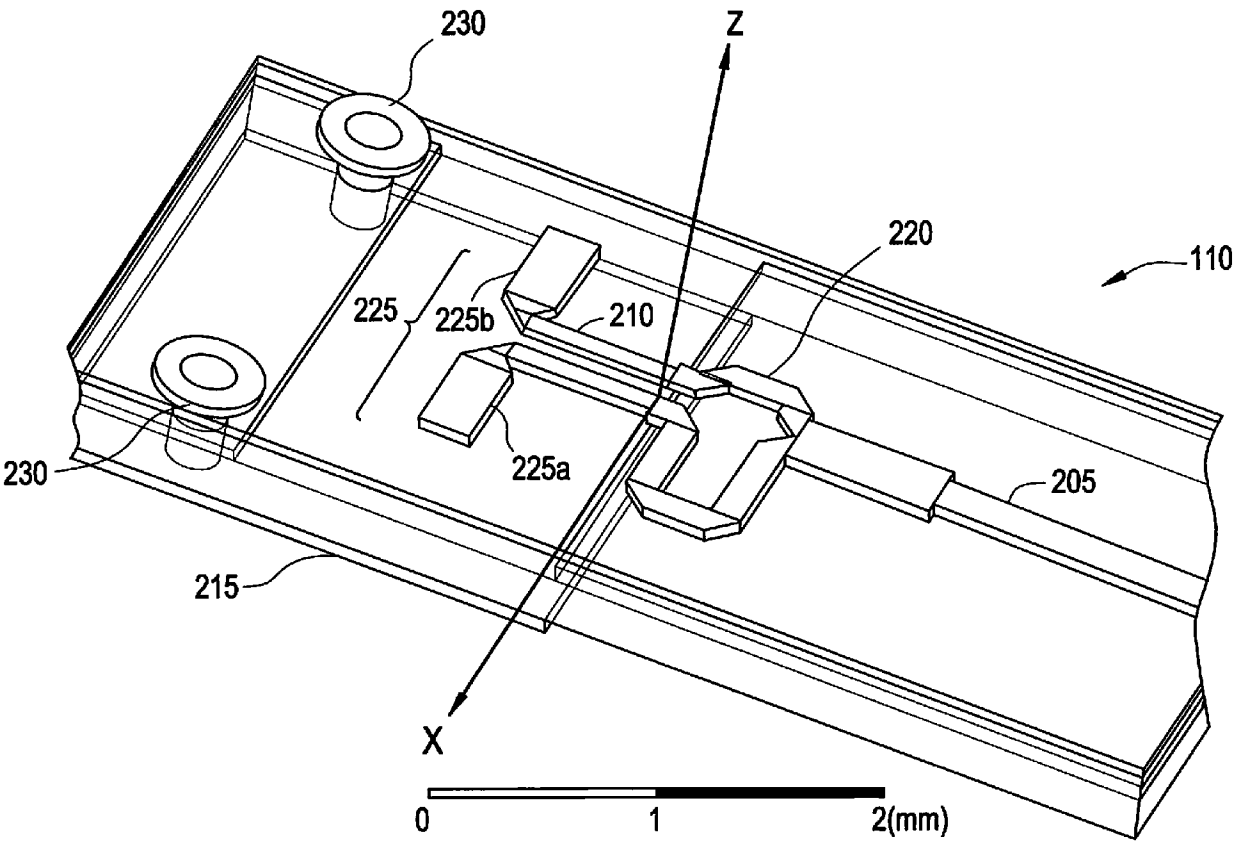
FIG. 2A illustrates an elevated view of an antenna in the antenna system of FIG. 1.
Figure 2B:
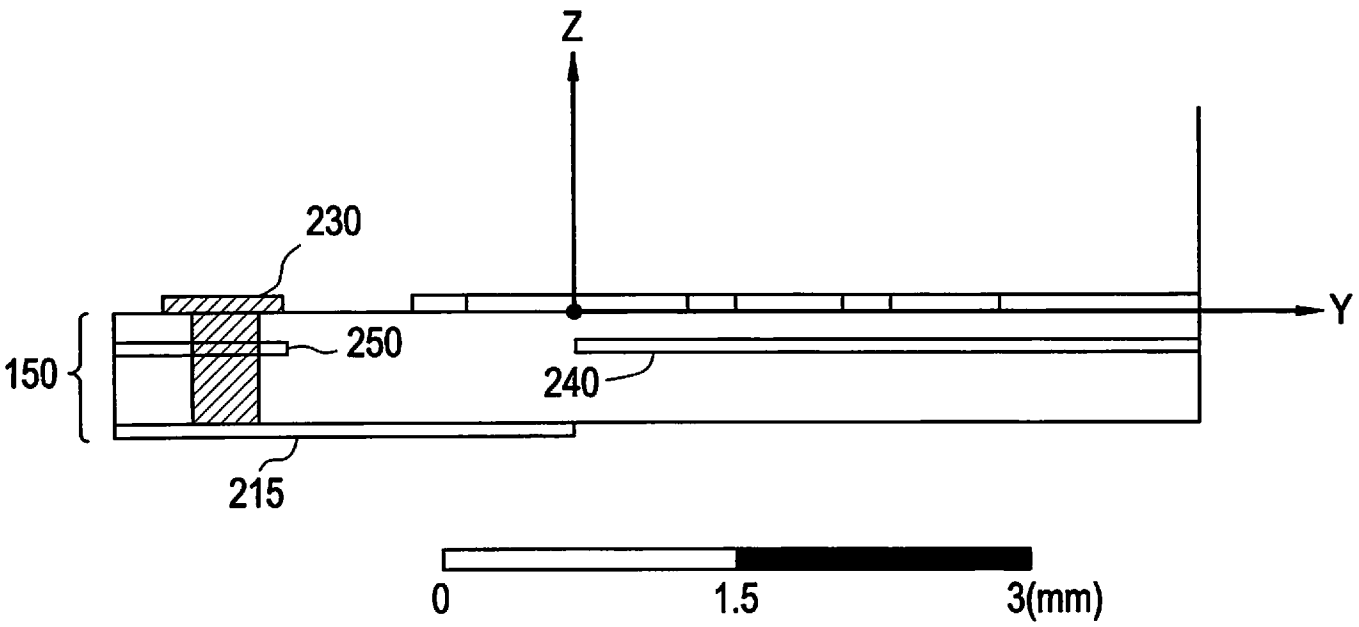
FIG. 2B illustrates a side of view of the antenna shown in FIG. 2A.

FIG. 2A illustrates an elevated view of one of the antennas shown in FIG. 1 and FIG. 2B illustrates a side view of the antenna. The plurality of antennas 110*a*-110*d* are all the same. Thus, for the sake of brevity, only one antenna 110*a* will be described.

The antenna 110*a* is a dipole antenna fed by microstrip line 205 with transition to a broadband coplanar stripline (CPS) 210. A uniplanar balun (balanced to unbalanced transformer) 220 can be designed as broadband and is coupled between the CPS 210 and the microstrip line 205.

The antenna 110*a* is backed by a conductor ground plane 215 that acts as quarter-wave reflector.

A radiating element 225 is fed by the uniplanar balun 220. The uniplanar balun 220 eliminates the need for RF signal vias.

The radiating element 225 includes portions 225*a* and 225*b*, which form a dipole element. The portions 225*a* and 225*b* act as a driver element fed by the CPS 210 in terms of Yagi antenna principle with reflector element and director element.

The antenna 110*a* and its array 100 is an entire antenna element and its array includes the quarter-wave reflector 215 in the single substrate fabrication 150 as opposed to having multiple fabrication and integration steps.

The antenna 110*a* also includes ground vias 230. The ground vias 230 suppress endfire propagation and direct the antenna 110*a* to form broadside radiation with a gain of 6-dB. Such broadside radiation enables antenna operation in a low profile implementation.

As shown in FIG. 2B, the substrate 150 is manufactured with a microstrip ground plane 240 and a ground plane 250, in additional to the quarter-wave reflector 215.

The conductor ground plane 215 is located at a bottom of the substrate 150 and extends from a first end of the substrate 150 to below the coupling of the CPS 210 and the balun 220. The microstrip ground plane 240 extends from a second end of the substrate 150 to below the coupling of the CPS 210 and the balun 220. As such, one end of the conductor ground plane 215 is aligned with one end of the microstrip ground plane 240. However, it should be understood that the conductor ground plane 215 may extend further underneath the microstrip ground plane 240.

The ground plane 250 extends from the first end of the substrate 150 past the ground vias 230. As shown, the ground vias 230 extend from the conductor ground plane 215 to over the substrate 150. The ground vias 230 pass through the ground plate 250 in the present example embodiment for ease of fabrication using a through via. However, in other example embodiments, the ground vias 230 can be stopped at 250 to form a blind via.

The ground plane 250 is placed approximately at a quarter-wave away from the dipole element 225 to prevent the wave to radiate toward end-fire direction. The ground plane 215 may be placed approximately quarter-wave away from the dipole element 225 to be an effective reflective element toward broadside radiation. By adjusting the positions of the ground planes 215 and 250, the bandwidth of the antenna can be designed much wider than a conventional dipole antenna or patch antenna. The positions of the ground planes 215 and 250 may be adjusted based on a desired antenna radiation pattern, and a desired input impedance matching.

Figure 2C:
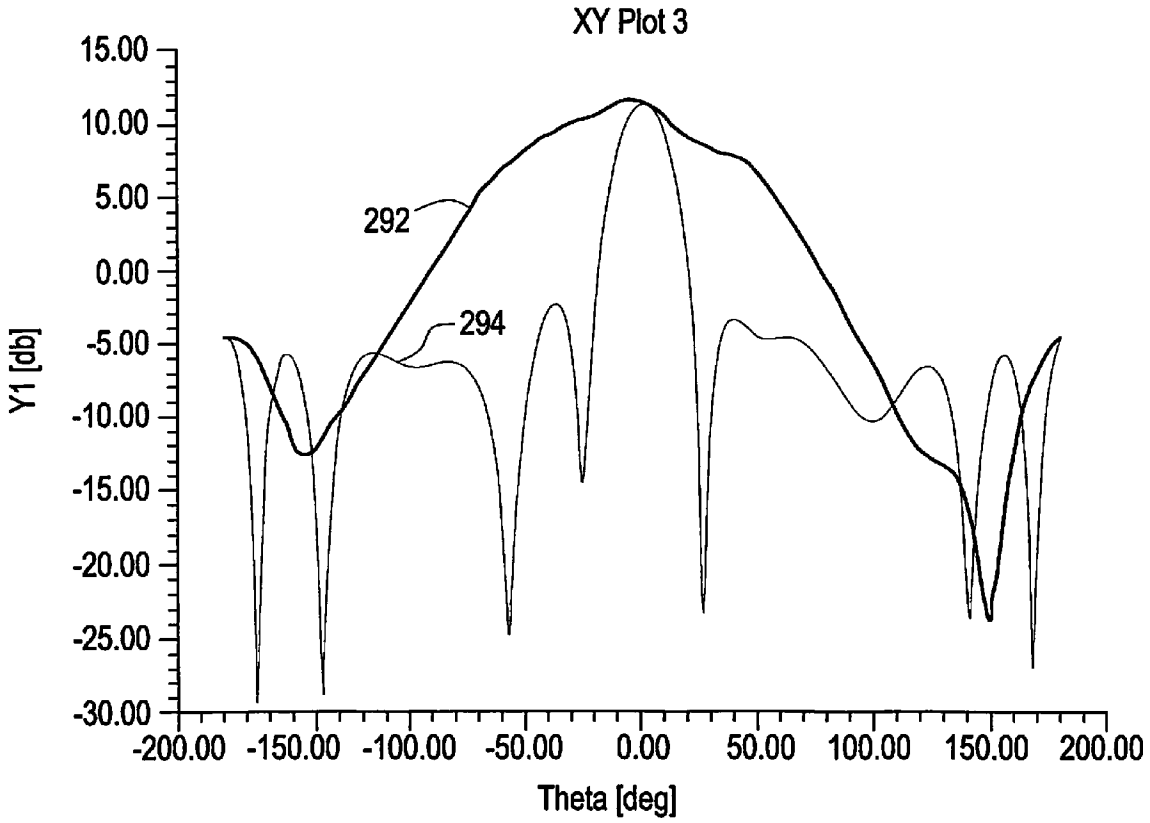
FIGS. 2C-2D, illustrate mutual coupling between elements field distribution properties of an antenna according to an example embodiment.
Figure 2D:
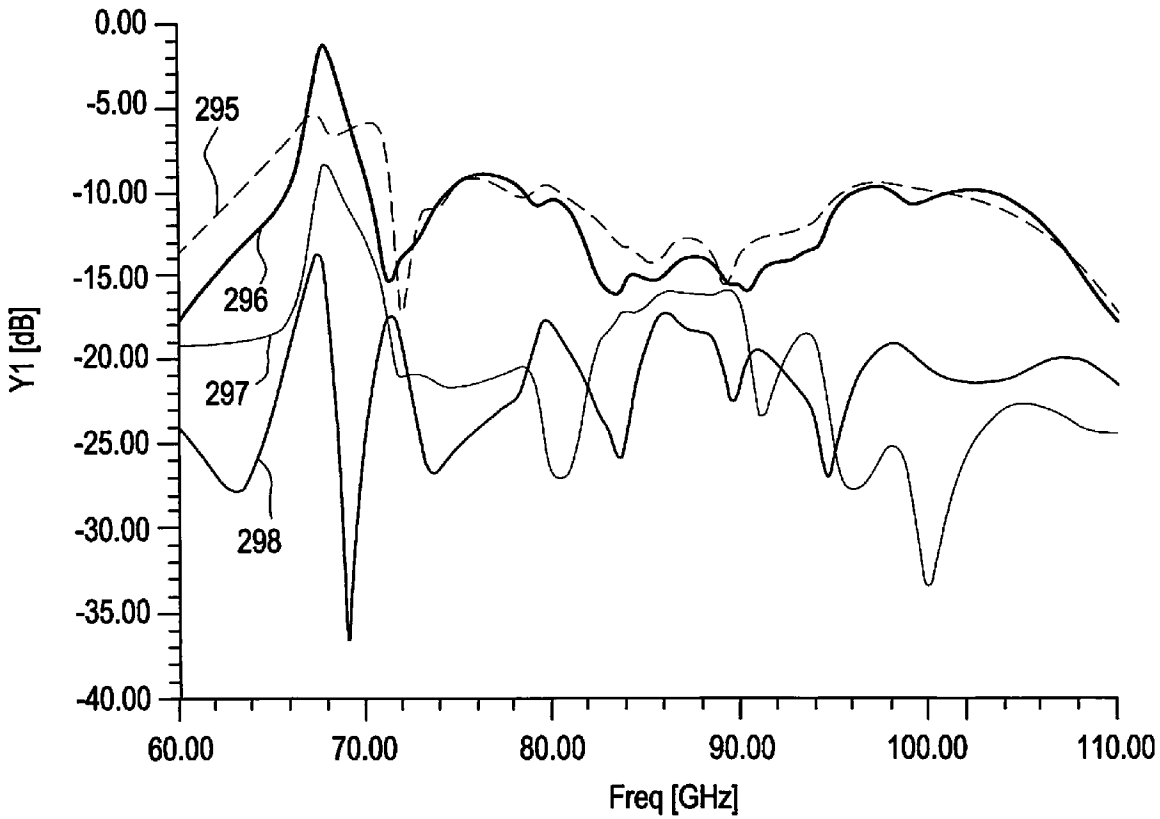

FIG. 2C shows the antenna radiation pattern where line 292 is the H-plane radiation pattern and line 294 is the E-plane radiation pattern according to an example embodiment. The antenna achieves good radiation pattern with low side robe and 11 dB gain based on the 4-element antenna array. FIG. 2D shows the 4-port S-parameters of the 4-element antenna array. Line 295 is the input return loss of one of the antenna element (110*a*) which sits at the edge of the array and line 296 is the input return loss of another antenna element (110*b*) which sits in the middle of the array. They both show broadband input matching where the input loss is higher than 10 dB over 20 GHz. Line 297 shows the mutual coupling between 110*a* and 110*b* and line 298 shows the mutual coupling between 110*b* and 110*c*. Those results indicate the low mutual coupling between elements are achieved (mutual coupling between any combination is below −15 dB over the entire W-band) due mainly to the good field distribution of the dipole element.

Figure 3A:
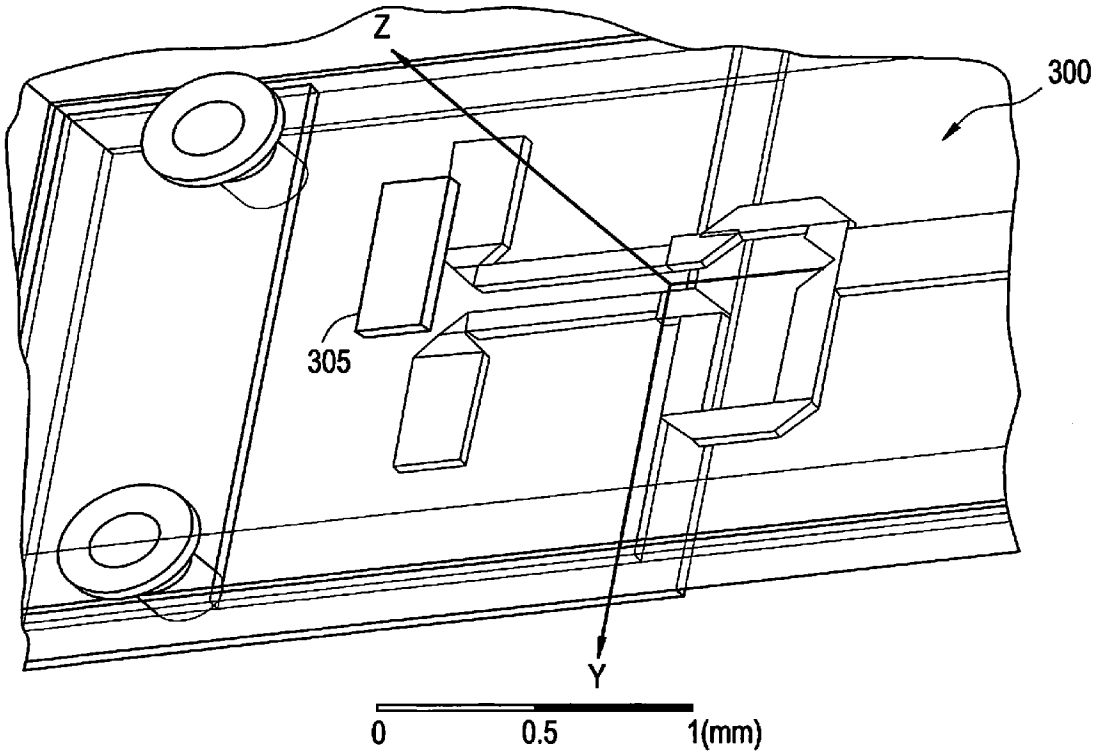
FIG. 3A illustrates an elevated view of an antenna according to another example embodiment.
Figure 3B:
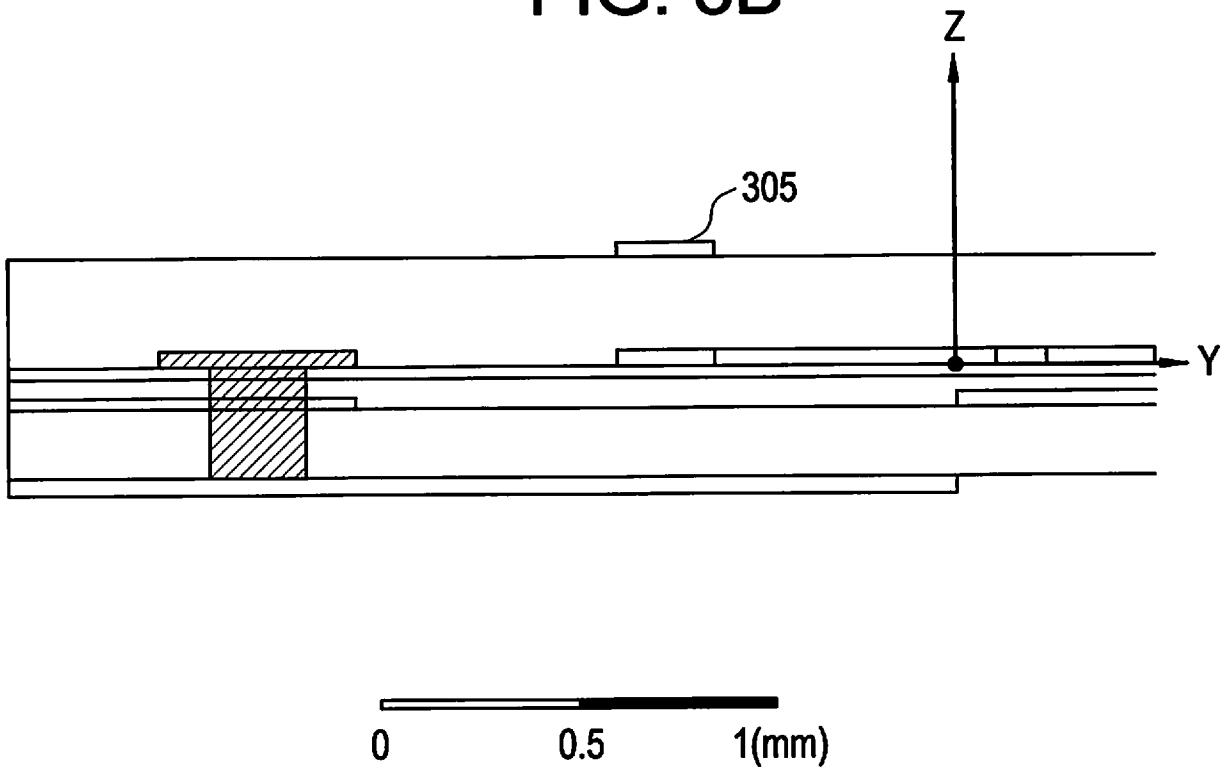
FIG. 3B illustrates a side view of the antenna shown in FIG. 3A.

The antenna 110*a* can be extended to add director elements to form a Yagi antenna in broadside radiation, as shown in FIGS. 3A and 3B. The Yagi antenna 300 is the same as the antenna 110, shown in FIG. 2A, except for the addition of a director 305. Thus, for the sake of brevity, only the differences between the antenna 110*a* and the antenna 300 will be described.

As shown in FIG. 3B, the director 305 is on a top plane and directs antenna propagation toward broadside direction. The director 305 can help increase the gain of the antenna element and antenna array. The director 305 also can act as an impedance matching element as well providing yet wider broadband response of the antenna. In an example embodiment, the director 305 is placed approximately quarter-wave away from the driver 225. However, example embodiments are limited thereto. The positions can be adjusted and optimized to achieve higher gain, and/or wider bandwidth.

Figure 4:
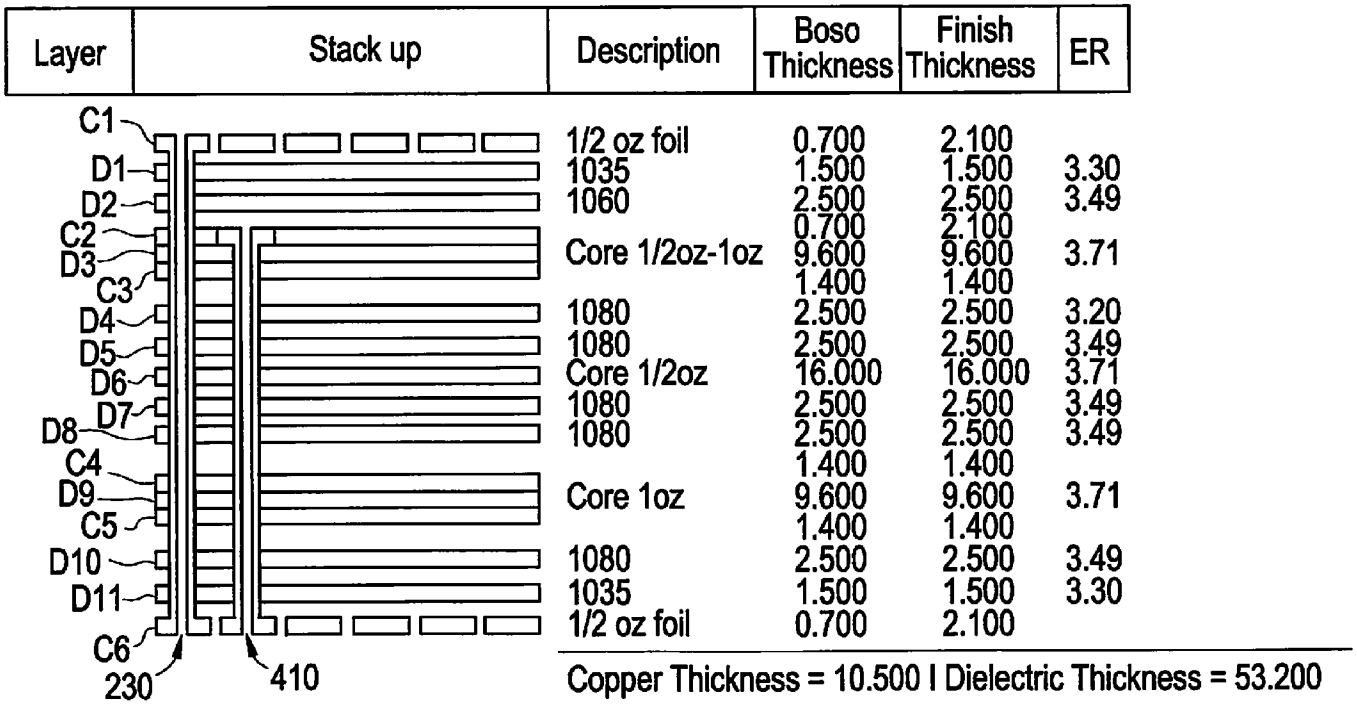

FIG. 4 illustrates an example embodiment of the substrate 150. As shown, the substrate 150 includes six layers of copper $C_1$-$C_6$. Copper layers $C_1$, $C_2$ and $C_6$ may have base thicknesses of 0.7 mil (thousandth of an inch) and a finish thicknesses of 2.1 mil. Copper layers can be replaced by other metals such as copper alloy and aluminum.

The substrate may include dielectric layers $D_1$-$D_{11}$ disposed between the six layers of copper $C_1$-$C_6$. As shown, dielectric layers $D_1$ and $D_2$ are between the copper layers $C_1$ and $C_2$. The dielectric layer $D_1$ has a base thickness of 1.5 mil and a finish thickness of 1.5 mil. The dielectric layer $D_2$ has a base thickness of 2.5 mil and a finish thickness of 2.5 mil. The dielectric layer $D_3$ is between the copper layers $C_2$ and $C_3$. The dielectric layer $D_3$ has a base thickness of 9.6 mil and a finish thickness of 9.6 mil. The dielectric layers $D_4$-$D_8$ are between the copper layers $C_3$ and $C_4$. The dielectric layers $D_4$, $D_5$, $D_6$, and $D_7$ have a base thickness of 2.5 mil and a finish thickness of 2.5 mil. The dielectric layer $D_6$ has a base thickness of 16 mil and a finish thickness of 16 mil. The dielectric layer $D_9$ is between the copper layers $C_4$ and $C_5$. The dielectric layer $D_9$ has a base thickness of 9.6 mil and a finish thickness of 9.6 mil. The dielectric layers $D_{10}$ and $D_{11}$ are between the copper layers $C_5$ and $C_6$. The dielectric layer $D_{10}$ has a base thickness of 2.5 mil and a finish thickness of 2.5 mil. The dielectric layer $D_{11}$ has a base thickness of 1.5 mil and a finish thickness of 1.5 mil. The layers $D_1$ through $D_{11}$ may all be Megtron 6 materials. Alternatively, some of the layers $D_1$ through $D_{11}$ can be prepreg Megtron 6 dielectric material used to bond other dielectric layers (typically called core layers) together while both prepreg and core materials are very similar in property.

The ground vias 230, which are used for the antenna, extend from the copper layer $C_1$ to the copper layer $C_6$. Vias 410 extend from the copper layer $C_1$ to the copper layer $C_6$. The vias 410 dissipate heat from ASICs integrated in the antenna system.

Figure 5:
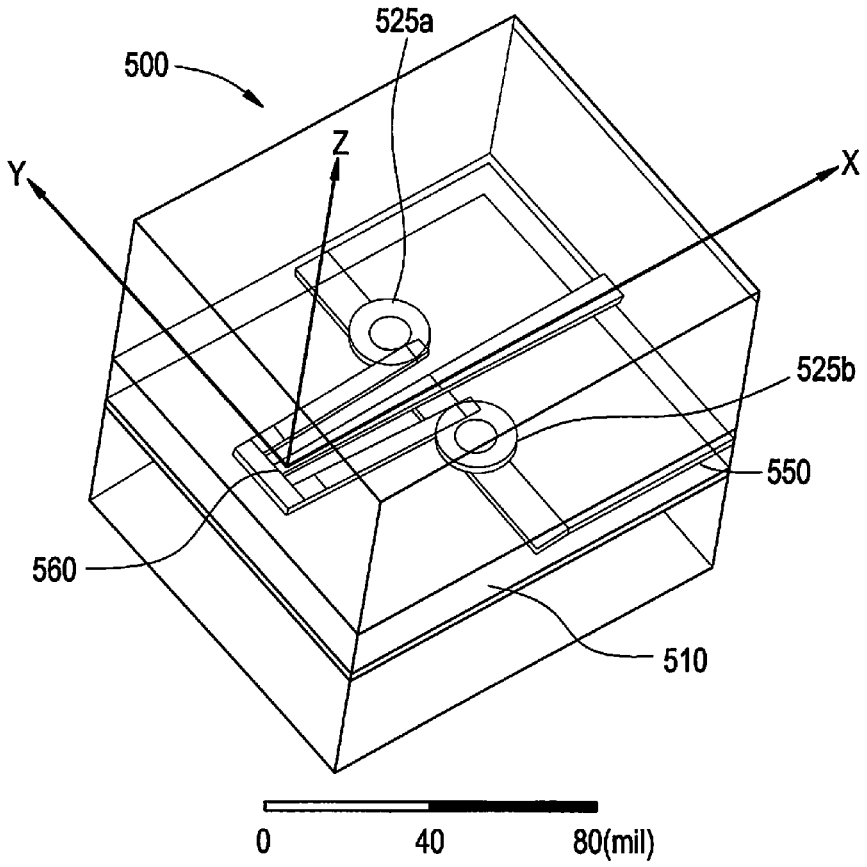
FIG. 5 illustrates a coplanar waveguide (CPW) antenna according to an example embodiment.

Moreover, while example embodiments are described with regards to microstrip antennas, it should be understood that coplanar waveguide (CPW) transition from the CPW based Silicon chip having CPW line to the microstrip line based antennas may be manufactured in a single fabrication process with a substrate by not including the microstrip ground plane 240. Such a CPW transition is shown in FIG. 5. The CPW transition 500 may be manufactured using the same single fabrication process used to produce the antennas 110. More specifically, the CPW transition 500 may be integrated with a substrate 510 in a single fabrication process. As shown, the CPW transition includes radiating elements 525*a* and 525*b* and a truncated ground plane 550.

The CPW transition 500 can be made with a single PCB process as the ground plane cutout position (where the ground plane truncation occurs) is aligned with the rest of the circuit such as ground vias. This is not readily done with the hybrid integration of multiple boards.

By removing the microstrip ground plane underneath the CPW wirebonding pad area 560, a CPW is formed and good impedance matching is created together with the ground vias.

Example embodiments being thus described, it will be obvious that the same may be varied in many ways. Such variations are not to be regarded as a departure from the spirit and scope of example embodiments, and all such modifications as would be obvious to one skilled in the art are intended to be included within the scope of the claims.

What is claimed is:

1. A broadside antenna system comprising:

a single printed circuit board (PCB) substrate, the single PCB substrate including, a truncated microstrip ground plane at a first side of the single PCB substrate, another ground plane at a second side of the single PCB substrate, the first and second sides being opposite sides of the single PCB substrate, a reflector at a third side of the single PCB substrate;

an antenna integrated with the single PCB substrate, the antenna being a broadside low-profile microstrip antenna, the antenna configured to act as a dipole antenna including a dipole driver element; and ground vias extending from the reflector to a top of the single PCB substrate.

2. The antenna system of claim 1, wherein the ground vias extend through the another ground plane.

3. The antenna system of claim 2, wherein the truncated microstrip ground plane is a quarter wave reflector.

4. The antenna system of claim 1, wherein the antenna includes a broadband coplanar stripline (CPS) to a microstrip balun, the CPS configured to receive a signal.

5. The antenna system of claim 1, wherein the antenna is configured to achieve broadband input impedance matching of a 20 GHz input return loss higher than 10 dB for a millimeter-wave operating band due to an optimization of multiple resonances in the system.

6. The antenna system of claim 1, wherein the antenna achieves mutual coupling between elements of the antenna system below −15 dB over a millimeter-wave operating band.

* * * * *